US006285006B1

(12) United States Patent
Hyllberg

(10) Patent No.: US 6,285,006 B1
(45) Date of Patent: Sep. 4, 2001

(54) CERAMIC HEATER/FUSER ROLLER WITH INTERNAL HEATER

(75) Inventor: Bruce E. Hyllberg, Gurnee, IL (US)

(73) Assignee: American Roller Company, Union Grove, CT (US)

( * ) Notice: Subject to any disclaimer, the term of this patent is extended or adjusted under 35 U.S.C. 154(b) by 0 days.

(21) Appl. No.: 09/614,320

(22) Filed: Jul. 12, 2000

(51) Int. Cl.[7] ..... G03G 15/20

(52) U.S. Cl. ..... 219/216; 219/469; 399/330; 399/333

(58) Field of Search ..... 219/216, 469–471, 219/521, 522; 399/330, 333

(56) References Cited

U.S. PATENT DOCUMENTS

| | | | | |
|---|---|---|---|---|
| 3,624,353 | * | 11/1971 | Bjorklund | 219/470 |
| 4,388,523 | * | 6/1983 | Keep, Jr. et al. | 219/541 |
| 4,745,431 | * | 5/1988 | Kogure et al. | 219/216 |
| 4,801,968 | | 1/1989 | Kogure et al. . | |
| 4,810,858 | | 3/1989 | Urban et al. . | |
| 4,813,372 | | 3/1989 | Kogure et al. . | |
| 4,820,904 | | 4/1989 | Urban . | |
| 5,093,556 | * | 3/1992 | Oelfke | 219/521 |
| 5,191,381 | | 3/1993 | Yuan . | |
| 5,213,828 | * | 5/1993 | Winter et al. | 219/522 |
| 5,408,070 | | 4/1995 | Hyllberg . | |
| 5,420,395 | | 5/1995 | Hyllberg et al. . | |
| 5,616,263 | * | 4/1997 | Hyllberg | 219/469 |
| 5,722,025 | * | 2/1998 | Morigami et al. | 399/330 |
| 5,729,814 | * | 3/1998 | Suzuki et al. | 399/333 |
| 5,869,808 | * | 2/1999 | Hyllberg | 219/216 |
| 5,906,762 | * | 5/1999 | Okabayashi | 219/216 |
| 6,054,677 | * | 4/2000 | Morigami et al. | 219/216 |
| 6,091,051 | * | 7/2000 | Morigami et al. | 219/216 |
| 6,122,479 | * | 9/2000 | Fujita et al. | 399/333 |
| 6,137,969 | * | 10/2000 | Tsujimoto | 219/216 |

* cited by examiner

*Primary Examiner*—Joseph Pelham
(74) *Attorney, Agent, or Firm*—Quarles & Brady LLP

(57) ABSTRACT

A thermal conduction roller (10) has a tubular roller core (11) with an inside surface; and an electrical insulator coat (16) primarily of zirconia on the inside surface, a heater coat (18) of titania or a titania blend is disposed over the insulator coat (16), and at least two electrical contact assemblies that are disposed inside the roller and electrically connect to the heater coat (18) as the roller (10) is being rotated. One embodiment utilizes an electrical insulator coat (16) in a range of thickness from about ten mils to about twenty mils. A thinner coat may not have sufficient dielectric strength, while a thicker coat decreases thermal conduction. A release material (12) is applied to the outside of the roller (10). Various contact structures according to the present invention are also described in detail, including one especially adapted to connect to a three-phase power supply.

28 Claims, 5 Drawing Sheets

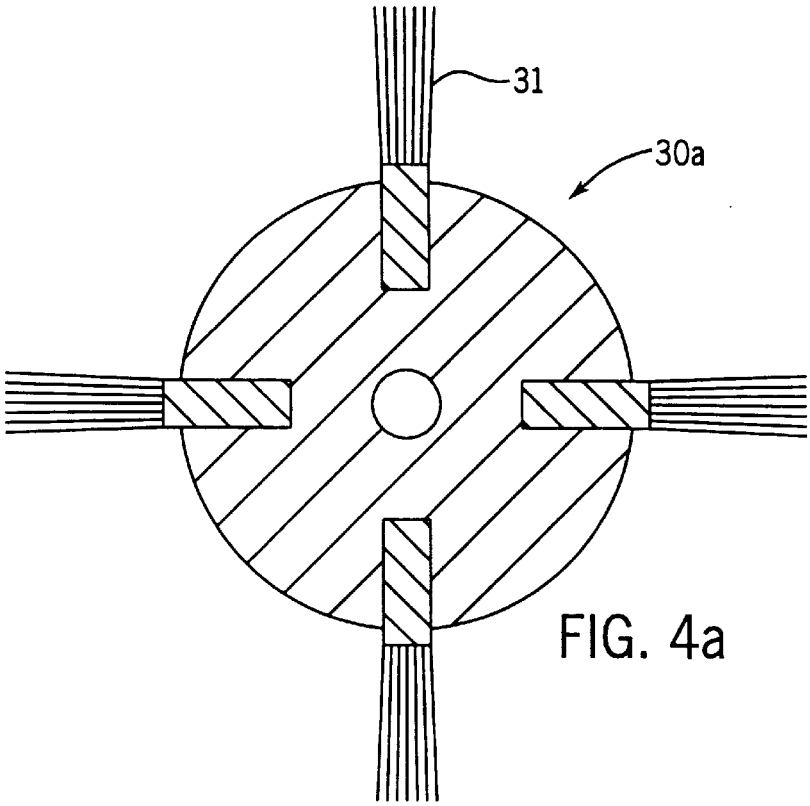
FIG. 4a
FIG. 4b
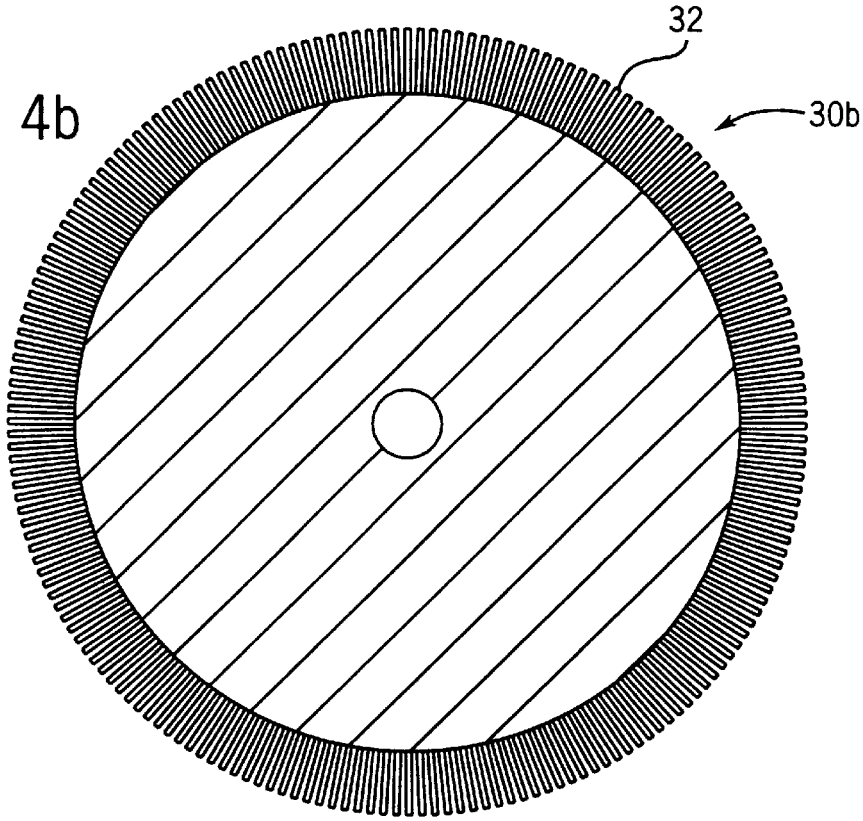

CERAMIC HEATER/FUSER ROLLER WITH INTERNAL HEATER

TECHNICAL FIELD

The invention relates to the heater/fuser rollers for use in copy machines, printing applications and industrial uses.

DESCRIPTION OF THE BACKGROUND ART

The conventional copy machine fuser roller uses a non-rotating quartz lamp inside the rotating fuser roller core.

The inside of the aluminum core has a black coating to promote heat absorption. All heat transfer to the roller core tube is by radiation from the quartz lamp. This is inefficient and requires higher temperature at the lamp surface to transfer heat for a given power level, than does heat transfer by conduction. The roller also has an outer cover of silicone rubber, Teflon, or another release layer that will operate at high temperature to prevent toner build-up.

Ceramics have been proposed for heater/fuser rollers in Kogure, U.S. Pat. No. 4,813,372 and U.S. Pat. No. 4,801,968; Urban, U.S. Pat. No. 4,810,858; and Yuan, U.S. Pat. No. 5,191,381. The designs in these patents are complex and not readily adapted to present day manufacturing and use. These designs typically place the ceramic layer on the outside of the roller core.

Hyllberg, U.S. Pat. No. 5,408,070, discloses a heater/fuser roller with a thermal regulating layer and a heating layer disposed inside the roller core.

A general object of the present invention is to improve on the prior art ceramic heater roller construction to provide a simple, low cost, easy to manufacture ceramic heater roller with the heater inside a hollow center of the roller core and without a thermal regulating layer of type seen in U.S. Pat. No. 5,408,070.

Recently, energy saving guidelines for copiers have required shorter ramp up times to the fusing temperature (about 200° C., 392° F.), lower idling temperatures to reduce heat losses, and lower heat losses over all.

A further object of the present invention is to provide a ceramic heater/roller with internal heater that provides improved ramp up operation to the fusing temperature.

Hyllberg, U.S. patent application Ser. No. 84,650, issued as U.S. Pat. No. 5,420,395, discloses a roller with electrode bands formed on a heater layer inside of a roller core. It is further object of the invention to improve upon the arrangement disclosed there by providing contact assemblies that fit within the roller and provide continuous electrical connection as the roller is being rotated.

SUMMARY OF THE INVENTION

The invention concerns a thermal conduction roller having a tubular roller core with an inside surface, an electrical insulator coat primarily of zirconia on the inside surface, a heater coat disposed over the insulator coat, and at least two electrical contact assemblies that are disposed inside the roller and provide continuous electrical connection to the heater coat as the roller is being rotated.

A particular advantageous embodiment utilizes an electrical insulator coat in a range of thickness from about ten mils to about twenty mils. A thinner coat may not have sufficient dielectric strength, while a thicker coat decreases thermal conduction.

In most embodiments a release material is applied to the outside of the roller.

It is also advantageous to seal the insulator coat with a silicone elastomer.

Titania is a preferred material for the heater coat, although blends of titania and other ceramic materials or metals or alloys may also be used.

Various contact structures according to the present invention are also described in detail, including one especially adapted to connect to a three-phase power supply.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

BRIEF DESCRIPTION OF THE DRAWINGS

FIGS. 4*a* and 4*b* are side views in elevation of brush structures that can be utilized in the embodiment of FIG. 3;

DETAILED DESCRIPTION OF THE PREFERRED EMBODIMENTS

Figure 1:
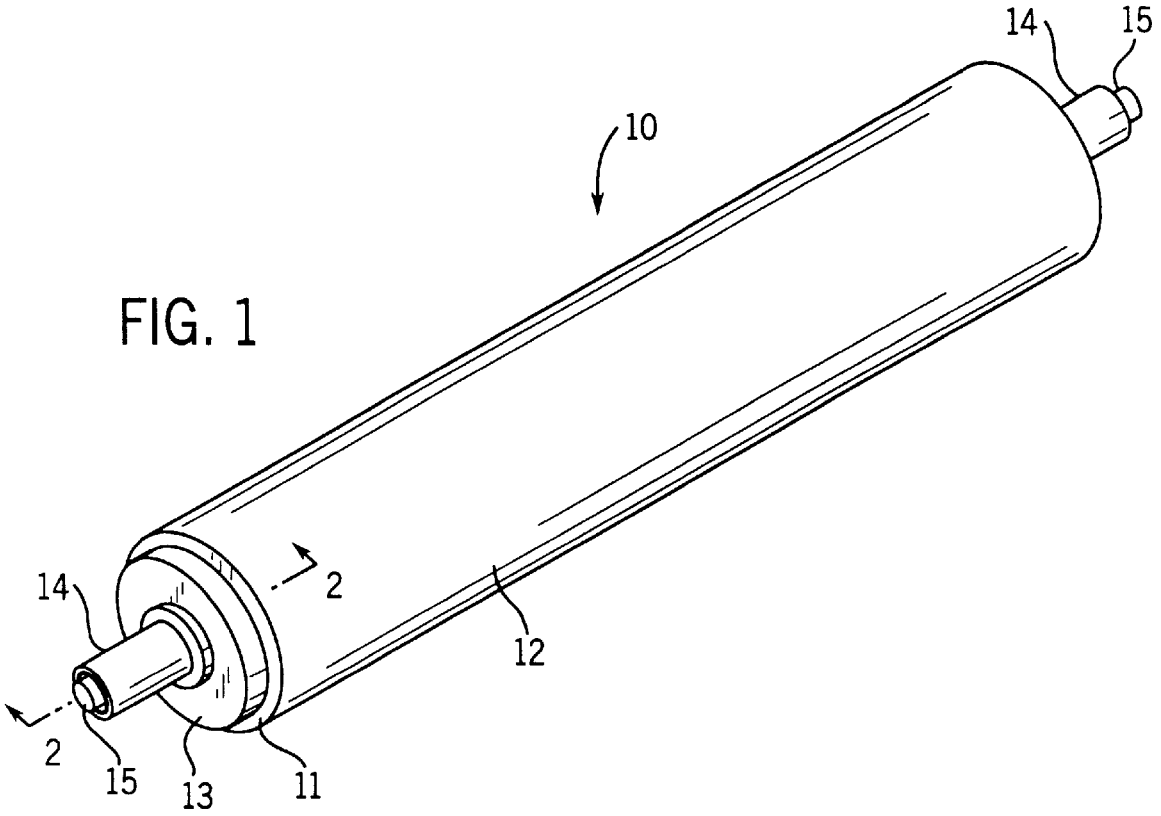
FIG. 1 is a perspective view of a roller incorporating the present invention.

Referring to FIG. 1, a roller 10 of the present invention includes a tubular roller core 11 covered with a release coating 12. The roller 10 has end pieces 13 disposed in opposite ends of the core 11 and journal shafts 14 are connected to the end pieces 13 on opposite ends for rotational mounting of the roller 10 in a machine. Inside the journal shafts 14, which are hollow, are stationary center shafts 15 about which the roller 10 will rotate.

The tubular roller core 11 is typically a metal, such as steel or aluminum. The preferred material of the core 11 is steel, or another metal alloy with a similar coefficient of thermal expansion (CTE). The closer the core 11 is to the CTE value for the ceramic coatings to be added, the less effect the core 11 has on these coatings at high temperature.

Figure 2:
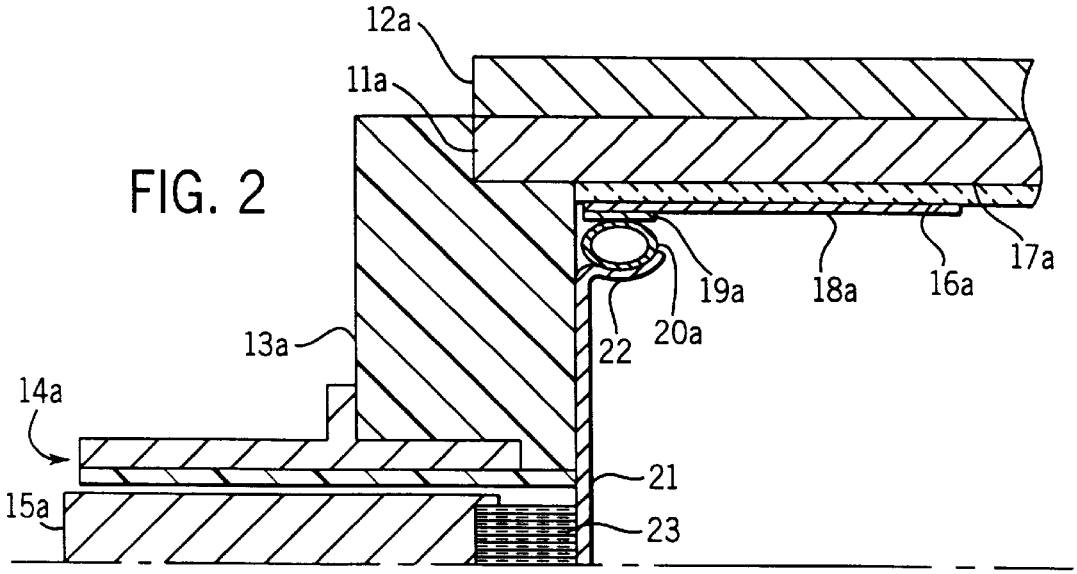
FIG. 2 is a detail sectional view of a first embodiment of the present invention taken in a plane indicated by line 2—2in FIG. 1.
Figure 3:
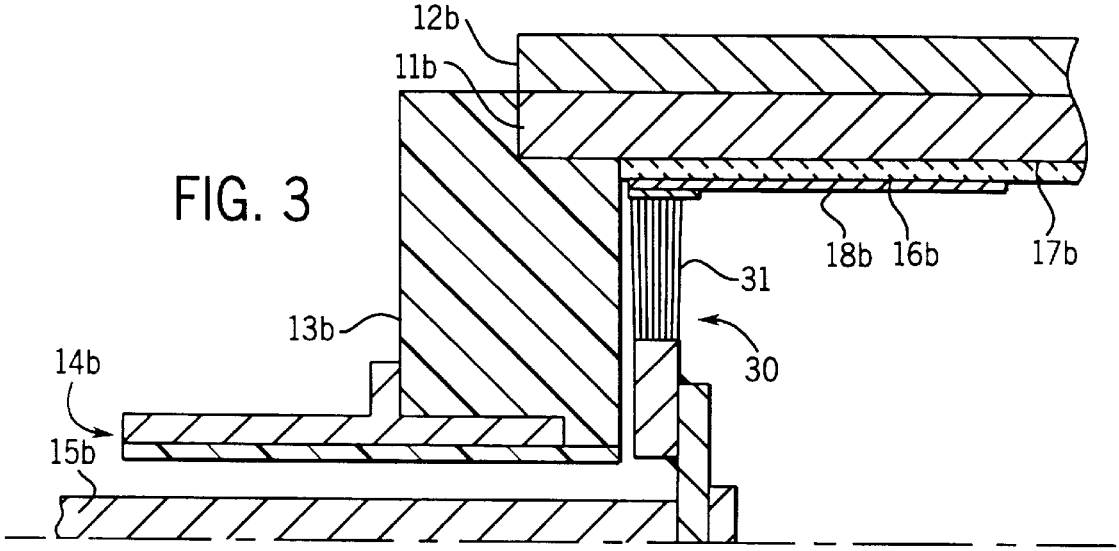
FIG. 3 is a detail sectional view of a second embodiment of the present invention taken in the same plane as FIG. 2.
Figure 5:
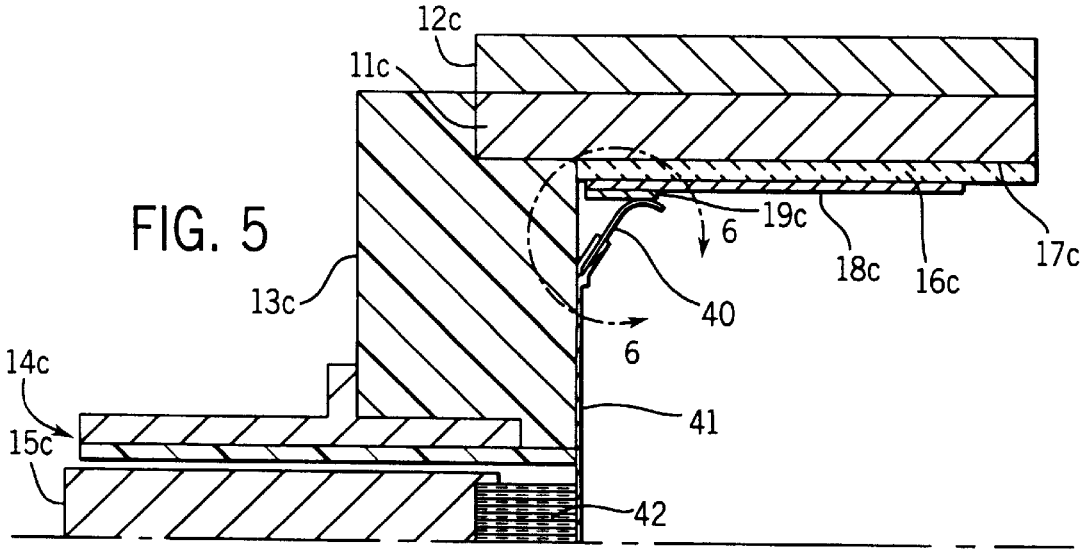
FIG. 5 is a detail sectional view of a third embodiment of the present invention taken in the same plane as FIG. 2.

The core 11 may optionally contain an integral heat pipe as disclosed in Hyllberg, U.S. Pat. No. 5,984,848. The core 11 may also optionally include conventional tube-type heat pipes inserted in gun-drilled holes. The end pieces 13 are made of metal or are made of a thermal insulating material as seen in FIGS. 2, 3 and 5, to reduce heat losses near the ends of the roller 10.

In the following description, the base reference numerals for the embodiments in FIGS. 2, 3, 5 and 8 are given suffixes "a", "b", "c" and "d", respectively. When no suffix is used, the reference numeral is generic and refers to parts with the same base reference numeral in all embodiments.

An electrically insulating ceramic coat 16, containing or primarily composed of zirconia, is applied by plasma spraying to the inside surface 17 of the tubular roller core, between the end pieces, to a thickness in a range of from five to 100 mils, but preferably between about ten and about twenty mils. The insulating coat 16 further comprises a plurality of thinner coats formed by a number of passes of a thermal spraying device to form the insulating coat 16. The zirconia is zirconium oxide blended with a small percentage of yttrium, magnesium, calcium, or cerium oxides to stabilize the crystal structure ("stabilized" zirconia).

Zirconia is selected instead of alumina for the present invention due to its performance with regard to thermal shock. Blends of zirconia with other ceramics can also be used with some reduction in thermal shock resistance. Alumina can be used as an insulator but may crack at temperatures above 500° F. on steel cores. Zirconia does not readily crack on steel or aluminum, but may be subject to dielectric failure above 700° F.

To minimize cost and maximize the heat transfer rate to the core 11, the ceramic insulator 16 for the 240 volt range is only 10 mils thick. Usage at 120 volts would allow a slightly thinner coating (but not half). Usage at 480 volts would be slightly thicker (10 to 20 mils). The practical voltage range for an office copier is 120 to 240 volts. Industrial rollers can be used at voltages up to 480. AC or DC current can be used to power the heater coat.

An optional plasma sprayed coat of a bonding material (nickel aluminide, nickel chromium, etc.) (not visible in the drawings) may be first applied to the core 11 to promote adhesion of the insulating coat 16.

A heater coat 18, primarily composed of titanium dioxide, applied by plasma spraying on top of the ceramic insulator 16, is built up in thin coats to a specified resistance, over a slightly shorter length than the insulator 16 (see FIGS. 2, 3 and 5) to provide spacing between the end of the heater coat 18 and nearby grounded surfaces.

The heater coat is from about 0.5 to about 2.0 mils thick for a total ceramic thickness of from about eleven or about twelve mils. A bond coat, such as Sulzer Metco 480 nickel aluminide alloy is preferably applied to the steel core 11 before the ceramic insulator 16, in a coat about three to five mils thick. The first few mils of the insulator coat 16 only serve to cover the peaks of the bond coat. The remainder of the insulator coat 16 provides electrical insulation between the core and the heater coat 18.

A sealer is applied to the ceramic insulator coat 16 to improve the dielectric strength of the ceramic insulator 16, but is not an absolute necessity as long as the dielectric strength and resistance of the ceramic insulator 16 are adequate for the application. The risk of contamination of the ceramic is greatly reduced when the ceramic is on the inside of the core 11 as compared to the outside of the core 11. A low viscosity silicone elastomer-is preferred due to the high operating temperature of the roller 10. A typical silicone elastomer can operate continuously at 400° F. with minimal degradation and excellent dielectric properties. Materials are available that are room temperature cured (RTV) or oven cured.

An optional metal electrode band 19, made preferably of nickel aluminide, can be applied by plasma spraying, to the ends (in a ring) of the heater coat 18 to promote electrical contact between a contact assembly and the heater coat 18.

An electrical contact 40 (FIGS. 5, 6) contacts the end portions the heater coat 18, with or without the sprayed metal band 19, that rotates with the roller 10. The contact 40 is comprised of a spring, metallic brush, or flexible metal contact to provide electrical connection to some or all of the circumference of the end portions of the heater coat 18, over the useful temperature range of the roller.

Optionally, an electrical contact 30 (FIG. 3) can be used that does not rotate with the roller 10, composed of a brush style contact 30*a* with individual brushes 31 (FIG. 4A) or in disk form 30*b*, 32 (FIG. 4B), to provide electrical connection to some or all of the circumference of the end portions of the heater, over the useful temperature range of the roller.

FIG. 2 shows a first embodiment of an electrical contact assembly for the present invention. A spring contact 20, in the shape of a ring, is used to make contact to the heater coat 18*a* or to a sprayed metal electrode band 19*a* which has been applied to the heater coat 18*a*. The spring 20 is made of a material that is both relatively low in resistance and yet maintains its spring-like properties at the operating temperature of the roller. Stainless steel wire, plain or plated with nickel, silver, brass, or bronze, can be used as well as nickel or steel wire, plain or plated. Plating is preferred to avoid possible corrosion issues especially on steel.

The spring holder 21 in this case is a low cost stamped metal ring of plain or plated steel or stainless with a curved lip 22 that forms a groove for holding the spring 20. The spring holder 21 is attached to the insulating header material by rivets or screws (not shown). In this case, a common carbon brush 23 is running directly against the spring holder disk 21 to provide the slip ring function. No wires or other electrical connections are required to connect the roller to an external power supply. One of the advantages of placing the heater coat 18*a* on the inside of the core 11 is the simplicity of the electrical connections. No end caps or covers are required which would affect the usable face length of the roller. The end of the roller 10 does not have to be tapered to accommodate the electrical connections as in the prior art. Connections inside the roller 10 can be left exposed, making them simpler and less costly. Outside the roller connections must be covered. Inside the roller, any failure, arcing or sparking, is contained within the roller. The core can be grounded at all times.

FIG. 3 shows another embodiment of an electrical contact to the roller. A brush style contact 30 (a bristle brush 31 not a carbon electrical brush of the type used with slip rings) is used to contact the heater directly or through an optional sprayed metal band electrode 19*b* on the heater 18*b*. This type of brush is disclosed in U.S. Pat. No. 4,398,113. The brushes can be individual brushes 31 with about a one quarter inch diameter (FIG. 4A) or the bristles 32 can be mounted to a metal disk (FIG. 4B) (or fixed between disks) so that the contact to the heater is around the complete circumference. The brushes 31,32 are stationary and are mounted on shafts 15*b* from both ends of the roller 10 or from a single shaft running the length of the roller 10.

Figure 6:
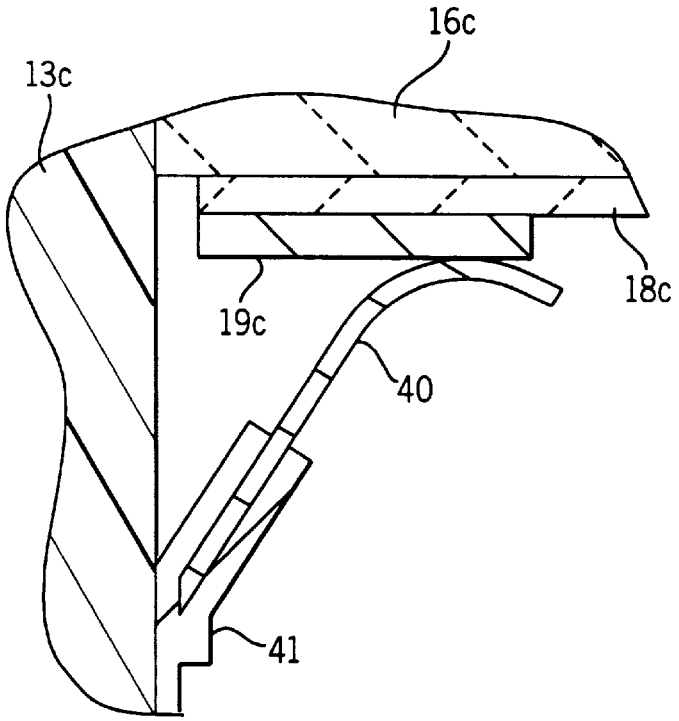
FIG. 6 is a detail view of contact structure seen in FIG. 5.

FIGS. 5 and 6 show an embodiment where a circular spring 40 makes contact to the heater coat 18*c*, with or without the sprayed metal electrode bands 19*c*, supported by a disk-shaped conductor 41. The spring 40 is slightly compressed to provide a constant tension in contacting the heater coat 18*c*. A shaft 15*c* is connected to the disk-shaped conductor (spring holder) 41 through a brush 42. As is normal for fuser rollers used in copiers and printers, a release coat 12*c* of silicone rubber or other material (normally 0.200 inches or less thick) is applied to the outer roller surface. Medium-sized laminator rollers, up to at least 12 inches in diameter by 80 inches in length, can benefit from this technology as well. These also have a silicone rubber cover up to one half inch thick. Larger rollers can also use the internal ceramic heater with or without a covering on the outer roller surface.

One advantage of the present invention is that it is easier and more straightforward to bond release materials to an exterior metal surface of the core 11 than to bond them to ceramic materials, especially if the release material has to be removed and replaced. If the heater is positioned inside the roller 10, there is also far less danger of damaging the heater when the release material is applied, removed, or reapplied. Another advantage is that, with the core 11 grounded, the outer surface of the roller has zero voltage and a zero shock hazard potential.

The initial goal of the invention was to make a roller 10 that would rise from 70° F. to 400° F. in 60 seconds. One factor to be considered is the number of watts applied per pound of core material. That number is approximately 700 watts per pound for steel and 1400 watts per pound for aluminum. Steel cores tested were 3 inches in diameter×16 inches long with an 0.080-inch thick wall for a roller weight of 2.8 pounds. Approximately 2000 watts will raise the temperature of the roller to 400° F. in 60 seconds. At 240 volts and 2000 watts, the current is 8.3 amps for a ceramic heater resistance of about 29 ohms. This results in a heater thickness of between 0.5 and 1.0 mils for this size of roller. To bring the 2.8 pound roller to 400° F. in only 30 seconds, 16.6 amps at 240 volts is required. A faster ramp time can be achieved if the core weight is reduced.

Most of the rollers tested had a ramp time to 400° F. in the range of 120 seconds. These were used for thermal cycle testing from the 120° F. to 140° F. range to the 400° F. to 420° F. range 9 to 10 times per hour on a continuous basis. To maximize the number of cycles per hour, the rollers were not cooled all the way to ambient after each heating cycle.

EXAMPLE 1

A steel core tube of three inches in diameter and 16 inches long with a 0.080-inch thick wall thickness was first grit blasted and then sprayed with a 4-mil thick layer of Sulzer Metco 480 nickel aluminide bond coat. A 10-mil thick layer of Norton 110 gray alumina was then applied by plasma spraying as an electrical insulator. A ceramic heater layer composed of a 0.5 to 1.0-mil thick layer of Eutectic 25040 titanium dioxide was applied over the insulator resulting in a heater layer resistance in the range of 60 ohms. One quarter inch wide bands of Sulzer Metco 480, 1-mil thick, were applied near the ends of the heater layer as electrode contacts. All ceramic layers were sealed with a low viscosity silicone elastomer which was then cured for 3 hours at 300° F. in a dry air oven. The roller was thermally cycled without failure from 140° F. to 400° F. several thousand times using an AC voltage of 208 volts, 60 cycle, applied by a solid state relay, closed looped temperature controller, and calibrated thermocouple sensor. Additional cycling of the same roller to a maximum of 500° F. caused a heater failure (cracking) within 30 cycles.

EXAMPLE 2

Another test roller was made in the same manner as the previous example except that the insulator was a 5 to 6 mil thick layer of Norton 110 alumina. As soon as the power was applied, the roller failed due to dielectric failure of the thin insulator.

EXAMPLE 3

Another test roller was made in the same manner as the first example except that the insulator was a 10-mil thick layer of Norton 204 stabilized zirconia. This roller was cycled 9000 times 160° F. to 520° F. without failure. The temperature was increased and the roller was cycled an additional 8000 times to 600° F. Increasing the maximum temperature to 700° F. resulted in dielectric failure of the insulator (208 volts AC) after about 118 cycles.

EXAMPLE 4

Another test roller was made like example 3 except that the core was 3×16 inch tube, 0.125 inch wall, of aluminum. Cycling the roller to 400° F. dramatically increased its resistance due to the thermal expansion difference between ceramic and aluminum. The cycling was discontinued after 2529 cycles to 400° F. without failure, because the ramp rate was slower than desired.

EXAMPLE 5

Another test roller was made according to example 4, also on an aluminum core. The initial ramp rate to 400° F. was 65 seconds. After 152 cycles, the ramp time had slowed to 162 seconds. After 485 cycles, the ramp time to 400° F. was 230 seconds. Testing was discontinued, without failure after 1841 cycles due to a slow ramp time.

EXAMPLE 6

A 3×16-inch steel core with a zirconia insulator (like example 3) was cycled 9 to 10 times per hour to 400–420° F. The initial ramp time was 118 seconds to 400° F. After about 100 cycles, the ramp time had increased 130 seconds, an increase of 10 percent. After 1500 cycles (one week), the ramp time had increased to 135 seconds (an additional 4 percent). After nearly 9452 cycles, the resistance and ramp time have not increased any further.

After several months, the roller achieved 54,000 thermal cycles from about 140° F. to 400° F. and maintained a stable ramp time of about 135 seconds from 70° F. to 400° F. (about one cycle every 6.3 minutes).

EXAMPLE 8

A second test roller of similar construction was made, and operated at a higher wattage for a faster ramp time. This roller was operated for 24,000 thermal cycles from about 140° F. to 400° F. and has a stable ramp time of about 50 seconds from about 70° F. to 400° F. This has produced the desired results and advantages of the present invention.

Figure 7:
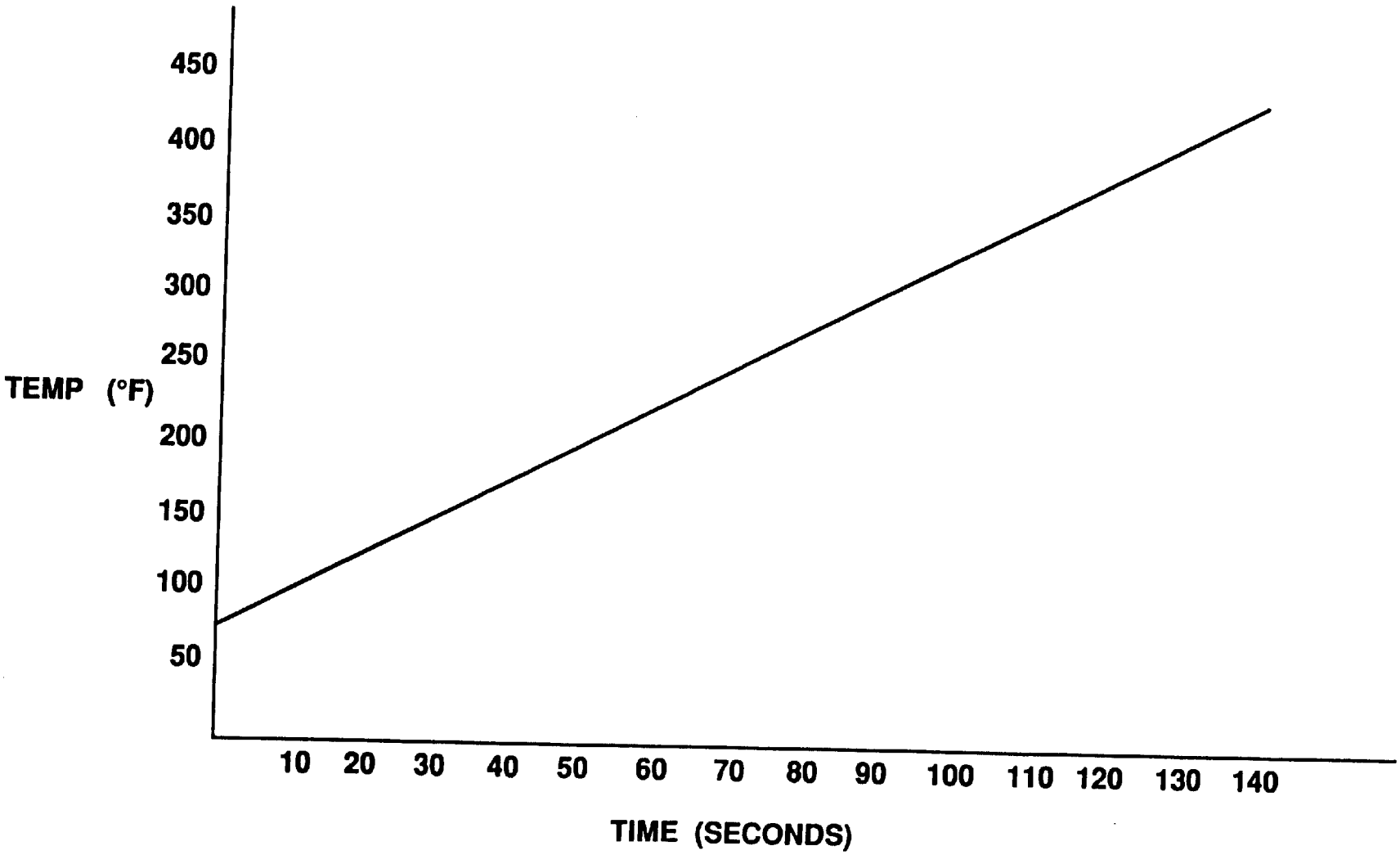
FIG. 7 is a graph of the rise in temperature vs. time for a roller according to the present invention.

FIG. 7 shows the time vs. temperature curve for a "quick rise fuser" roller of approximately 1000 watts. A single heat cycle (e.g., in an oven) to a predetermined higher temperature well above 400° F. could also "set" the heater resistance level in the same manner as hundreds of thermal cycles to 400° F. With this preheating step, no additional resistance change would be likely over the life of the heater, as long as the maximum usage temperature is not increased.

Figure 8:
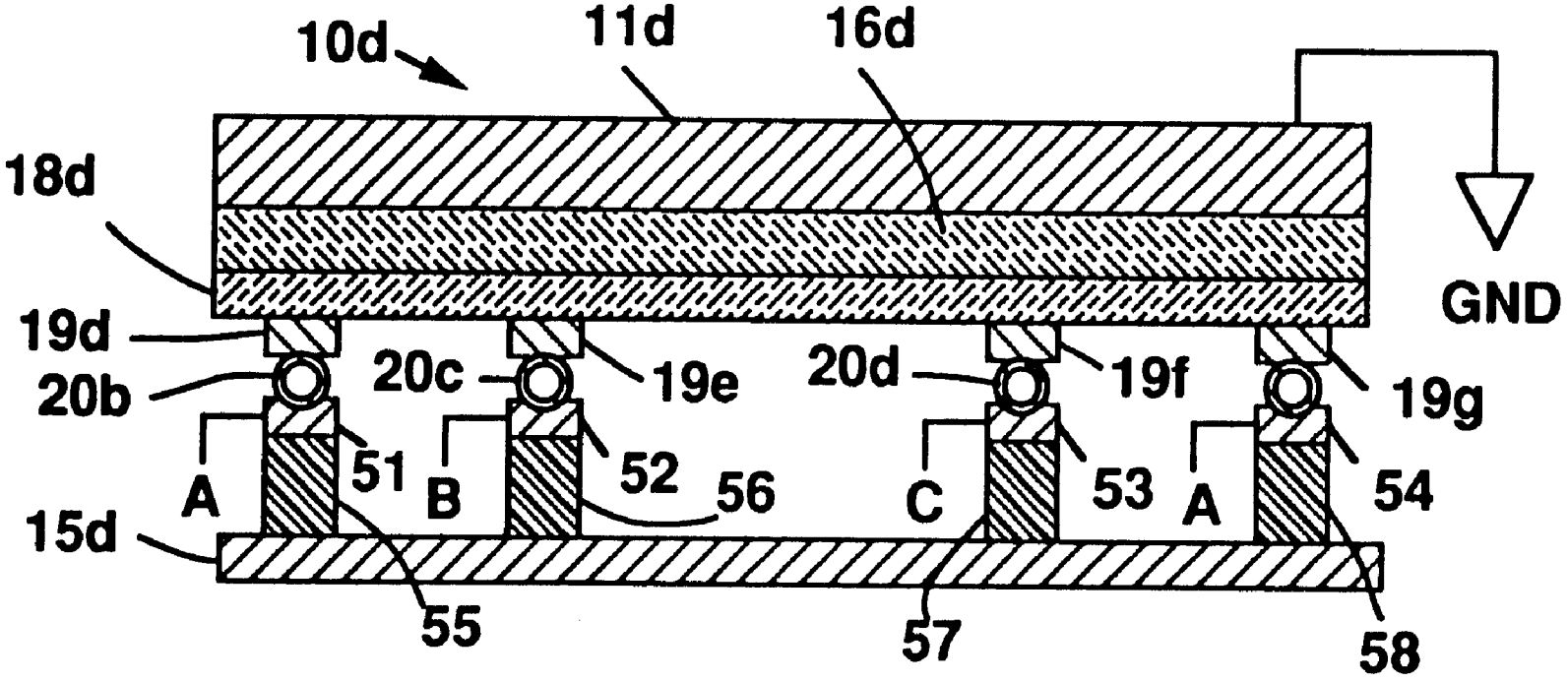
FIG. 8 is a sectional view of a fourth embodiment of the present invention utilizing heating zones.

Referring to FIG. 8, with the heater element 18*d* on the inside of the roller 10*d*, it is possible to provide for heating zones and for connection of three-phase power. Two electrodes 51, 54 utilizing spring-type contacts 20–20*e* are disposed near the ends of the roller 10*d*. By adding electrodes 52,53, it is possible to either divide the heater coat 18*d* into several heating zones or to energize the heater coat 18*d* with three-phase power.

For three phase connections, the heater coat 18*d* is divided into three zones defined as portions of the heater coat 18*d* between various pairs of the four electrodes 51, 52, 53 and 54. The electrodes 51, 52, 53 and 54 are supported on insulating disks 55, 56, 57 and 58, which are mounted on stationary shaft 15*d*. In a delta three-phase configuration, the heater coat 18*d* provides resistive loads between pairs of the respective electrodes 51, 52, 53 and 54. For the roller in FIG. 8, the outer electrodes 51, 54, for example, are both be connected to the A phase power line. The inner electrodes 52, 53 are then connected one to B phase power line and one to a C phase power line, respectively. This arrangement results in the above mentioned delta configuration with line-to-line voltages, $V_{AB}$, $V_{BC}$ and $V_{CA}$.

For a three-phase resistive heater connection, it is normal to have similar or equal resistive loads on each of the three circuit legs. For the heater coat 18*d*, this would require similar or equal spacing between the electrodes 51, 52, 53 and 54. For zone heating, the middle electrodes 52, 53 are typically further apart from each other than from the electrodes 51, 54 on opposite ends of the roller.

Single phase power would normally be used for zone heating. The various heated segments of the roller would be powered at different times, one at a time or in pairs for the end sections, by external switching of the leads connected to each electrode in the roller.

Heating rollers normally have some non-uniformity in the temperature profile during the ramp up to operating temperature and continuous run phases. During ramp up, the ends of the roller are lower in temperature than the middle portion of the roller, due to end losses and the heat sink effects of the roller end pieces and journal members. During normal usage or an extended run, the roller ends may be hotter than the portion of the roller that is covered by the web, since the roller ends are continuously producing heat but have a minimal thermal load. Unless the roller is fitted with heat pipe devices or heating zone controls, these thermal load factors will cause large temperature variations across the roller face.

In FIG. 8, each electrode 51, 52, 53 and 54 would have its own power wire connection running to the slip ring (rotary electrical connector) at a respective end of the roller 10*d*. By alternating the power supplied (alternate times or by external switching), to the sections between the electrodes 51, 52, 53 and 54, the temperature profile can be leveled with a variety of load conditions applied to the heated roller 10*d*.

In the case of a ceramic heater roller with the heater on the inside diameter, the electrodes can be positioned and the zones established according to the needs of the user, since their positions do not interfere with the functioning of the roller surface. The electrode positions can optionally be adjusted by the user, rather than permanently fixing them at the factory. If the sprayed metal bands are used on the heater, then the electrode positions are fixed to these locations. If the sprayed metal bands are not used, the electrodes can be located at any position. If the zones near the roller ends are rather short, it might be necessary to power them with a lower voltage than the main portion of the roller, or to connect the end segments in series, to avoid excessive amperages.

The internal contact electrodes for either three phase or zoned arrangements can be the same as previously described in FIGS. 2, 3 and 5. The electrodes can be stationary or can be used as a type of slip ring. The style most suitable for a slip ring contact is the conductive (bristle) brush style shown in FIG. 3.

The stationary conductive bristle style brush can also be mounted inside an internal contact electrode to provide a slip ring function while avoiding direct contact of the bristle brush with the ceramic heater (not shown).

The above has been a description of the detailed, preferred embodiments of the apparatus of the present invention. Various modifications to the details which are described above, which will be apparent to those of ordinary skill in the art, are included within the scope of the invention, as will become apparent from the following claims.

I claim:

1. A thermal conduction roller, comprising:

a tubular roller core having a hollow inside;

an electrical insulator coat disposed on the inside of the roller core and having a thickness in a range from about 5 mils to about 100 mils;

a heater coat comprising a ceramic material that is disposed over the insulating coat; and at least two electrical contact assemblies that are disposed inside the roller core and provide continuous electrical connection to the heater coat as the roller is being rotated;

wherein each of the two electrical contact assemblies further comprises a disk fastened to rotate with the roller core; a resilient element attached to said disk and urged into electrical connection with said heater coat; and an electrical connection in contact with said disk as it rotates with said roller core.

2. The roller of claim 1; wherein the thickness of the insulator coat is in a range from about 10 mils to about 20 mils.

3. The roller of claim 1, wherein the thickness of the heater coat is in a range from about 0.5 mils to about 2 mils.

4. The roller of claim 3, wherein the heater coat is formed of plasma-sprayed titania.

5. The roller of claim 1, wherein said insulator coat further comprises a plurality of thinner coats formed by a number of passes of a thermal spraying device to form the insulating coat.

6. The roller of claim 1, further comprising a release coating applied to an outside of the roller core.

7. The roller of claim 1, further comprising a silicone elastomer sealant applied to the ceramic insulator coat.

8. The roller of claim 1, wherein the resilient element is a flexible spring extending radially from said disk.

9. The roller of claim 1, wherein the resilient element is a coiled spring which runs circumferentially inside said core and wherein said disk forms a groove for supporting said coiled spring in electrical connection with said heater coat.

10. A thermal conduction roller, comprising:

a tubular roller core having a hollow inside;

an electrical insulator coat on the inside of the roller core and having a thickness in a range from about 5 mils to about 100 mils;

a heater coat comprising a ceramic material that is disposed over the insulating coat;

at least two electrical contact assemblies that are disposed inside the roller core and provide continuous electrical connection to the heater coat as the roller is being rotated; and further comprising at least one additional contact assembly disposed in between said first-mentioned contact assemblies to divide the heater coat into zones.

11. The roller of claim 10, further comprising at least two additional contact assemblies disposed in between said first mentioned contact assemblies and wherein the spacing between said at least two additional contact assemblies is greater than their spacing from said first-mentioned contact assemblies.

12. The roller of claim 11, wherein the spacing between said at least two additional contact assemblies and said first-mentioned contact assemblies is equal.

13. The roller of claim 11, further comprising connections to an external three-phase power supply.

14. The roller of claim 10, wherein the core is steel or aluminum.

15. The roller of claim 10, further comprising a bond coat disposed on the roller core underneath the electrical insulator coat.

16. The roller of claim 10, wherein the electrical insulator coat is formed of a material including zirconia.

17. The roller of claim 10, wherein the electrical insulator coat is formed primarily of zirconia.

18. The roller of claim 10, wherein the electrical insulator coat is formed of alumina.

19. The roller of claim 10, wherein electrode bands are disposed on a surface of the heater coat inside the tubular roller core and wherein the contact assemblies physically contact respective electrode bands to provide electrical connection to the heater coat.

20. The roller of claim 10, wherein the heater coat further comprises a metal or an alloy material.

21. A thermal conduction roller, comprising:

a tubular roller core having a hollow inside;

an electrical insulator coat disposed inside the roller core and having a thickness in a range from about 5 mils to about 100 mils;

a heater coat comprising a ceramic material that is disposed over the insulating coat; and at least two electrical contact assemblies that are disposed inside the roller core and provide continuous electrical connection to the heater coat as the roller is being rotated wherein each of the two electrical contact assemblies is supported by a disk and comprises a spring disposed on said disk and urged into electrical connection with said heater coat, and an electrical connection to said disk.

22. The roller of claim 21, wherein the roller includes a non-conductive header at one end of the roller and wherein said disk is fastened to said header.

23. The roller of claim 21, wherein the disk is mounted on a stationary shaft disposed along a central axis of the roller.

24. The roller of claim 21, wherein the spring is a flexible member extending from said disk.

25. The roller of claim 21, wherein the spring is a coiled spring which runs around at least a portion of an inside of said roller core and wherein said disk forms a groove for supporting said coiled spring in electrical connection with said heater coat.

26. The roller of claim 21, further comprising at least two conductive bands disposed on the heater coat inside the roller core and wherein the coiled spring in each electrical contact assembly contacts a respective one of said two conductive bands.

27. The roller of claim 21, wherein the spring is a coiled spring which provides continuous contact 360 degrees around an inside of the roller core.

28. The roller of claim 21, wherein the spring is a coiled spring which is in compression.

* * * * *